United States Patent [19]

Harrington

[11] Patent Number: 4,798,334

[45] Date of Patent: Jan. 17, 1989

[54] APPARATUS FOR SPRAYING A LIQUID IN A VESSEL

[75] Inventor: Max G. Harrington, Citrus Heights, Calif.

[73] Assignee: New West Engineering, Ltd., Citrus Heights, Calif.

[21] Appl. No.: 100,827

[22] Filed: Sep. 25, 1987

[51] Int. Cl.[4] ..... B05B 13/06; B05B 3/18

[52] U.S. Cl. ..... 239/227; 239/263.1; 239/263.3; 134/167 R; 134/172; 74/110; 118/DIG. 10; 118/317

[58] Field of Search ..... 239/225.1, 227, 263.1, 239/263.3, 264; 134/166 R, 167 R, 169 R, 172, 175; 118/317, DIG. 10; 74/110

[56] References Cited

U.S. PATENT DOCUMENTS

| | | | |
|---|---|---|---|
| 3,599,871 | 8/1971 | Ruppel et al. | 239/227 |
| 3,645,452 | 2/1972 | Stoeckel et al. | 239/227 |
| 3,690,730 | 9/1972 | Sakata et al. | 302/15 |
| 3,791,583 | 2/1974 | Nunlist et al. | 239/227 |
| 3,813,299 | 5/1974 | Bugor | 134/24 |
| 3,892,633 | 7/1975 | Oleszko et al. | 201/2 |
| 3,901,252 | 8/1975 | Riebe | 134/56 |
| 4,082,057 | 4/1978 | Hayes | 118/9 |
| 4,220,170 | 9/1980 | Hebert et al. | 134/167 |
| 4,244,523 | 1/1981 | Looper | 239/227 |
| 4,479,612 | 10/1984 | Umbach et al. | 239/280 |
| 4,514,443 | 4/1985 | Kostecki | 118/317 |
| 4,646,768 | 3/1987 | Tanaka et al. | 134/167 |
| 4,662,557 | 5/1987 | Lee | 74/110 |
| 4,664,720 | 5/1987 | Rucker | 134/22.1 |
| 4,718,293 | 1/1988 | Muta | 74/110 |

*Primary Examiner*—Andres Kashnikow
*Assistant Examiner*—Christopher G. Trainor
*Attorney, Agent, or Firm*—Marjama & Pincelli

[57] ABSTRACT

An apparatus for cleaning a closed vessel having a retraction mechanism for extending or retracting a spray mechanism within the vessel. The apparatus includes a housing and door assembly for separating the spraying mechanism from the interior to the vessel when not in use.

8 Claims, 5 Drawing Sheets

APPARATUS FOR SPRAYING A LIQUID IN A VESSEL

The present invention is directed to an apparatus for directing a liquid spray against the interior walls of a vessel, and more particular to an apparatus for spray cleaning the interior of a closed vessel.

BACKGROUND OF THE INVENTION

Typical prior art devices are illustrated in U.S. Pat. Nos. 3,791,583 and 4,082,057. These two patents disclose cleaning apparatuses which are provided with a spray means which is retracted into a housing attached to a vessel when not in use. Typically these devices are operated by a hydraulic system which is relatively expensive to manufacture, install, repair and maintain. Additionally, with regard to such devices it is important that the spray means be properly positioned within the vessel. Because of this positioning, prior art devices use extension arms which are relatively long in length, usually at least as long as the distance it must extend into the vessel. Further in the some prior art devices, the fluid which provides wash head pressure is also used to provide pressure to the hydraulic system. Generally these devices are designed to be used with head pressures of 150 psi or higher. A head pressure of 1000 psi or higher may be used in some applications. As the pressure increases the strength and weight of prior art devices must necessarily increase to accommodate this increased pressure. This obviously results in an increase in cost to manufacturer.

Additionally in certain prior art devices, of example as illustrated in U.S. Pat. No. 4,082,057, an isolation valve is used to separate the cleaning apparatus from the vessel when not in use. Since some cleaning apparatus are about 12 inches in diameter, an isolation valve of 16 inches would be necessary. Such a valve could weigh as much as 1 ton and would be expensive to manufacture.

In some situations, the amount of space adjacent the vessel is limited, thereby making it virtually impossible to position the apparatus without substantial expense in modifying the surrounding site.

Another disadvantage of prior art devices is that they cannot be removed from the vessel without exposing the interior to atmosphere nor are they designed for easy use with multiple vessels.

Applicants have invented an improved cleaning apparatus that is simple in operation, reliable in performance, provides easy access for repair, relatively lightweight in construction and less expensive to manufacture. There is also provided means for easy removal of the apparatus without exposing the contents of the vessel and would permit use of the apparatus with multiple vessels. Additionally, there is provided means to extend the spray means into the vessel with a minimum amount of overall length to the apparatus.

SUMMARY OF THE INVENTION

In one aspect of the present invention there is provided an apparatus housing mounted externally of a vessel. A carrier assembly is slidably mounted within the housing. A spray support assembly is slidably mounted to the carrier assembly. Door means are provided for sealing the internal portion of the housing from the interior of the vessel. A spray means is mounted at the end of the spray support assembly. A fluid delivery system is provided within the housing for delivering fluid to the spray means. Means are provided for extending the carrier assembly into the vessel to the desired position using a single drive means.

In another aspect of the present invention, there is provided an apparatus housing mounted externally of a vessel. A carrier assembly is slidably mounted within the housing. A spray support assembly is slidably mounted to the carrier assembly. Door means are provided for sealing the internal portion of the housing from the interior of the vessel. A spray means is mounted at the end of the spray support assembly. A fluid delivery system is provided within the housing for delivering fluid to the spray means. Means are provided for moving the carrier assembly and spray support assembly at different rates using a single drive means.

In yet another aspect of the present invention there is provided an apparatus for directing a liquid spray against the interior walls of a vessel from a nozzle spray means comprising mounting a flange capable of being secured to a mounting flange of a vessel. An inner housing secured to said mounting flange of said apparatus. An outer housing removably mounted to said mounting flange of said apparatus, said inner and outer housing flange forming a compartmental area for holding a retractable spray means. A door assembly secured to said inner housing for sealing the interior of said vessel from the compartmental area regardless whether said outer housing is secured to said flange.

DETAILED DESCRIPTION OF THE INVENTION

Figure 1:
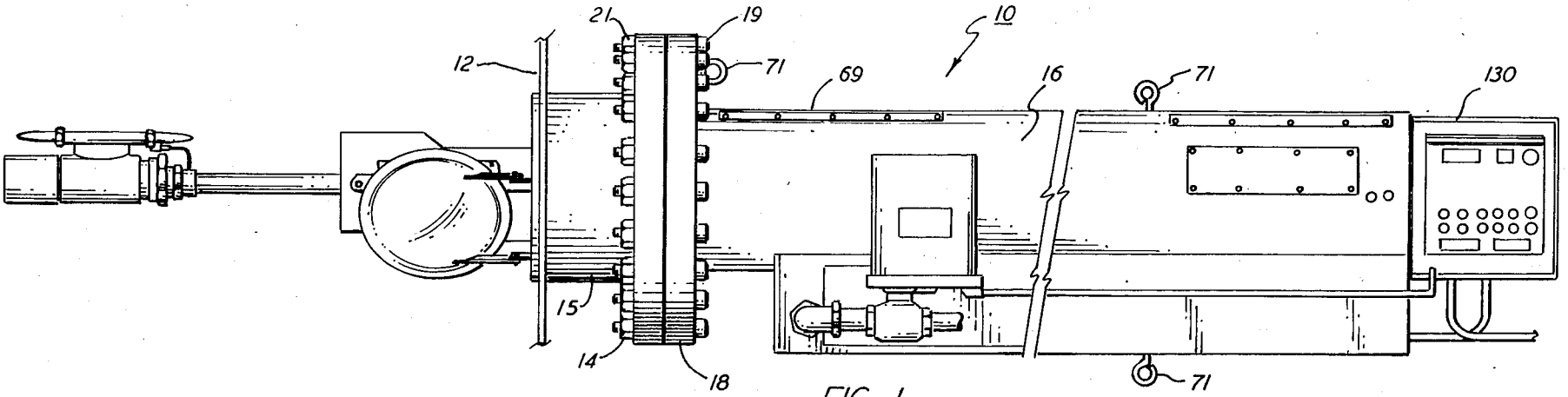
FIG. 1 is a front plan view of an apparatus according to the present invention mounted onto a vessel on which it is to be used.

Referring to FIGS. 1–4 there is illustrated a cleaning apparatus 10 according to the present invention. The cleaning apparatus 10 is mounted to a closed vessel 12. Only a portion of vessel 12 is illustrated for the purpose of clarity. The vessel 12 may be of any type, for example, but not by way of limitation, tanks used in the chemical processing, food, beverage, biochemical and pharmaceutical industries. The vessel 12 is provided with a mounting flange 14 connected to vessel 12 by a cylindrical sleeve 15. The apparatus 10 has an outer housing 16, a mounting flange 18 for securing the apparatus 10 to the vessel mounting flange 14 by appropriate securing means and an inner housing 24 which extends into vessel 12. In the particular embodiment illustrated, vessel mounting flange 14 is secured to housing mounting flange 18 by a plurality of threaded bolts 19 which pass through aligned openings 20 in vessel mounting flange 14 and housing mounting flange 18 and are secured by threaded nuts 21.

Figure 5:
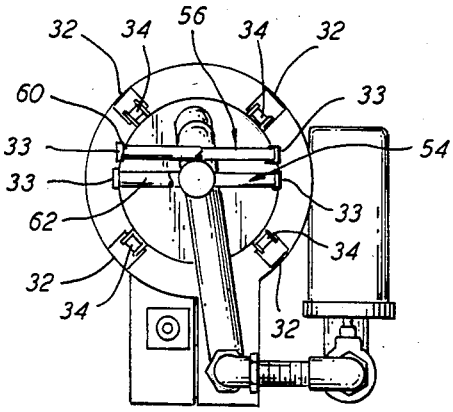
FIG. 5 is cross sectional view of the apparatus according to the present invention taken along line 5—5 of FIG. 2.

The inner housing 24 is securely attached to flange 18. In the particular embodiment illustrated, inner housing 24 is welded to flange 18. The outer housing 16 has an inner flange 26 which is removably secured to housing mounting flange 18 by a plurality of threaded bolts which engage threaded openings (not shown) in flange 18. Preferably, a gasket (not shown) is placed between inner flange 26 and mounting flange 18. Disposed within outer housing 16 and inner housing 24 is a retraction assembly for moving a spraying means into and out of vessel 12. The retraction assembly includes a carrier assembly 30 and spray support assembly 31. The carrier assembly is slidably mounted within inner housing 24 and outer housing 16. In the particular embodiment illustrated, carrier assembly 30 is slidably mounted through the use of guide roller assemblies 32. A plurality of guide roller assemblies 32 are placed at least two different locations along the length of carrier assembly 30 so that the carrier assembly 30 will be properly supported and aligned in housing 16 as it moves in and out of the housing 16. In the particular embodiment illustrated, guide rollers 32 are placed at two locations, one at the forward end of carrier assembly 30 and the other near the central area of the carrier assembly 30. As can best be seen in FIG. 5, at each location four guide rollers assemblies 32 are provided substantially equally spaced about the periphery of the carrier assembly 30. In the preferred embodiment illustrated, the carrier assembly comprises a cylindrical support tube 36. However, the carrier assembly 30 may take a variety of the cross sectional shapes, for example but not by way of limitation, square, oval or I-shaped. Tube 36 is provided with a forward top access opening 37 and a rearward top access opening 39 which permits access to spray support assembly 31. Tube 36 is further provided with bottom forward and rearward access openings 41 and 43.

The outer housing 16 is provided with a lower compartmental area 38 wherein a carrier drive assembly 40 is provided. Drive assembly 40 comprises a carrier drive motor 42 mounted to outer housing 16 and a threaded screw drive 44 rotatably mounted within compartmental area 38 by a pair of bearings 39. Drive motor 42 is connected to screw drive 44 by a coupler 46 so that the threaded screw drive 44 will rotate in response to operation of drive motor 42. Attached to tube 36 is a travel guide 48 which moves along threaded screw drive 44 in response to rotation of the screw drive 44 thereby moving carrier assembly 30 past the opening 25 at inner end 24 and door assembly 27 as illustrated in FIG. 1. In the embodiment illustrated travel guide 48 is attached to tube 36 by a pair of screws, however, guide 48 may be attached to tube 36 in any desired manner.

Spray support assembly 31 is slidably mounted within the carrier assembly 30 and includes a front collar assembly 52 and a rear collar assembly 54. The front collar assembly 52 is provided with a collar 53 and a front bearing support 56, support 56 has at its axial outer ends a pair of bearings 33 that are slidably mounted in receiving slots 60 in carrier assembly 30. In the particular embodiment illustrated, bearings 33 are made of TEFLON®. Rear collar assembly 54 comprises collar 61 and a rear bearing support 62. Rear bearing support 62 has a pair of bearings 33 slidably mounted in a pair of receiving slots 66 in carrier assembly. The front and rear collar assemblies 52 and 54 support the spray support assembly 31 within the carrier assembly 30. Spray support assembly 31 further includes a pipe 55 which is slidably mounted to front collar assembly 52 and securely attached to rear collar assembly 54. The pipe 55 is provided with a projection 59 which upon engaging front collar assembly 52 causes it to slide within slots 60. The forward end of pipe 55 is fluidly connected to spraying means 57 which is extended into vessel 12 for cleaning the vessel 12 by directing a spray against the interior walls of the vessel 12. The spray means 57 is retracted into inner housing 24 and outer housing 16 when not in use. The rear end of pipe 55 is fluidly connected to hose 74 which is connected to connector 75 on outer housing 16 which is fluidly connected to an appropriate source of fluid. The length hose 74 is such that it allows it to follow the end of pipe 55. In the particular embodiment illustrated, spray means 57 a rotating nozzle with controlled rotational speed such as that sold by Sybron Chemicals, Inc. under the trademark GAMAJET®. However, any spray means may be used as desired.

Figure 2:
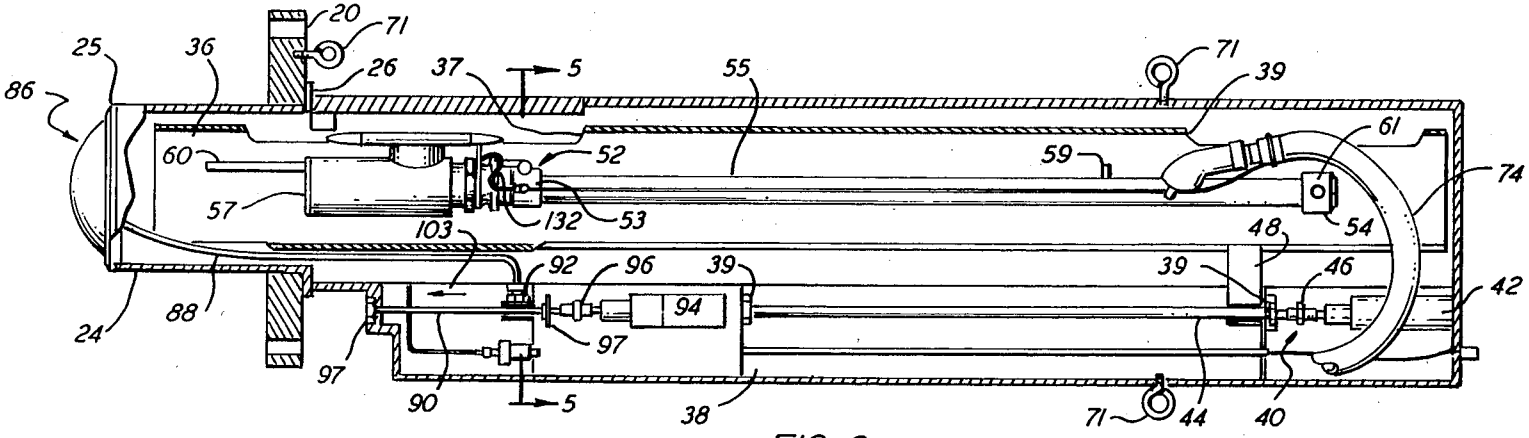
FIG. 2 is a front view partially broken away of the apparatus of FIG. 1 slightly enlarged wherein the retraction assembly is in the retracted position.
Figure 4:
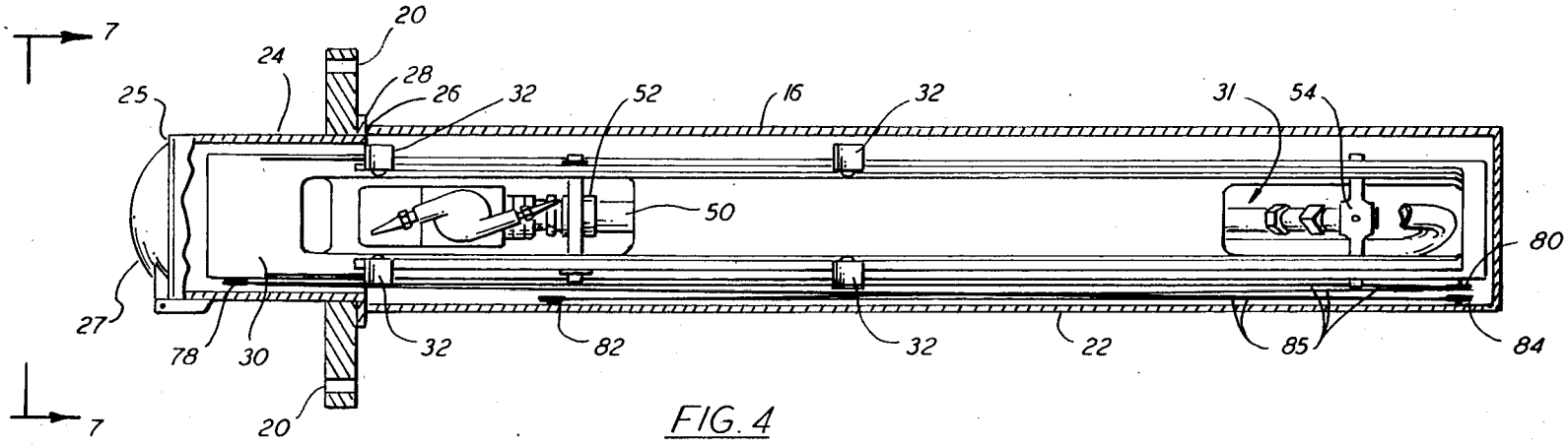
FIG. 4 is a top view of the apparatus of FIG. 1 slightly enlarged and partially broken away so as to illustrate the retraction assembly.
Figure 3:
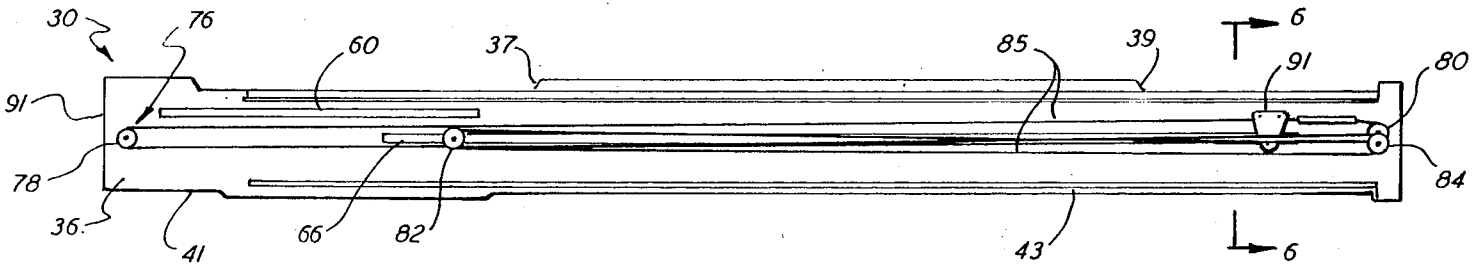
FIG. 3 is a front elevational view of the carrier assembly illustrated in FIG. 2.
Figure 7:
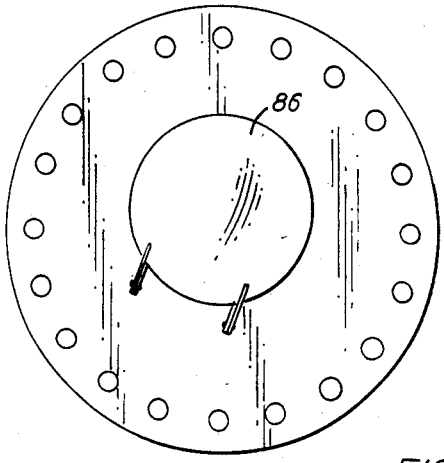
FIG. 7 is a side view of the apparatus of FIG. 4.
Figure 6:
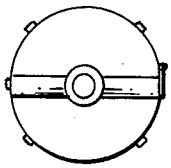
FIG. 6 is a side view of the carrier assembly taken along line 6—6 of FIG. 3.

Outer housing 16 is provided with an access panel 69 which is readily removable so that spray means 57 can be inspected and/or repaired through access opening 37 without removing the apparatus 10 from the vessel 12. As shown in FIGS. 1 and 2, housing 16 and flange 18 are provided with a plurality of support eye bolts 71 which are securely attached thereto. Since apparatus 10 is quite often relatively large and bulky, eye bolts 71 are used to assist in lifting and moving the apparatus 10. In the particular embodiment illustrated, the apparatus 10 is mounted in the substantial vertical position, however, the apparatus 10 may be mounted to the vessel in any direction, for example, in the horizontal direction in which case guides roller assemblies 32 would support the weight of carrier assembly 30.

A pulley system 76 is provided for moving the spray support assembly 31 in response to movement of the carrier assembly 30. The pulley system 76 comprises a first pulley 78 attached to the forward end of carrier assembly 30, a second pulley 80 attached to the rearward end of carrier assembly 30, a third pulley 82 attached to the inside surface of the housing 16 located near the forward end of the housing, and a fourth pulley 84 attached to the inside surface of the housing 16 near the rearward end of the housing 16. A drive wire 85 is wrapped about the pulleys 78, 80, 82 and 84 in a closed loop and is secured to the rearward collar assembly 54 of spray support assembly 31 by tab 91. The pulley system 76 as shown provides a three to one advantage. Therefore, for every inch carrier assembly 30 moves, spray support assembly moves three (3) inches. In this manner the overlength of housing 16 outside of vessel 14 can be minimized. The screw drive 44 moves the carrier assembly 30 past the door assembly 27 a first distance determined by the length of travel of traveler 48. The pulley system 76 extends the support assembly 31 beyond the end 91 of carrier assembly a second distance which is three times the first distance. While the particular embodiment illustrates a 3 to 1 ratio advantage any desired ratio advantage may be selected by the appropriate pulley arrangement as is well known to those skilled in art. One of the important features of the present invention is that the spray means 57 travels substantially further than the stroke of drive mechanism 40. Thus, a distance multiplier is provided by the carrier assembly 30, pulley system 76 and spray support assembly 31. Thus, the overall length of apparatus 10 can be kept to a minimum. In the particular embodiment illustrated, the spray means travels a distance of about 5 to 6 feet into vessel 12. In order to provide additional extension into the vessel 12, because of the multiple affect for a 3 to 1 ratio and an original overall apparatus 12 length of about 85.5 inches an additional increase of 12 inches in overall length can provide an 33% increase in projection of spray means 57 into vessel 12, an increase of 24 inches in overall length provides about a 92% increase in projection of spray means 57 into vessel 12, an increase of 36 inches in overall length provides about a 105% increase in projection of spray means 57 into vessel 12 and an 48 inches increase in overall length can provide an increase of about 140%. Not only does the present invention assist in minimizing the initial length, it also minimizes the additional lengths that may be desired. This is in contrast to hydraulic system of the prior art wherein additives lengths require the extension of the apparatus on a one to one basis. Another feature of the present invention is that only a single drive means is necessary for moving both the carrier assembly 30 and spray support assembly 31. Since both the carrier assembly 30 and spray support assembly 31. Since both the carrier assembly 30 and spray support assembly 31 are moving at the same time, they will move at different rates into the vessel. Yet still another feature of the present invention is its ability to position the spray means 57 at any desired point within the vessel and positively hold that position regardless of the head pressure. Due to the fraction between travel guide 48 and screw device 44 simply turning off motor 42 will keep the spray means in position. However, if desired additional braking or locking means may be provided to maintain carrier assembly 30 in position.

The door assembly 27 in the closed position maintains the spraying means 57 away from the environment of the vessel, thus avoiding any unnecessary exposure of the contents of the vessel 12 to the environment. The door assembly 27 in the open position permits entry of the carrier assembly 30 and spray support assembly 31 so that the spray means 57 can be properly located within the vessel 12.

Referring to FIGS. 2, 4, 8 and 9, there is illustrated door assembly 27 which comprises a door 86 hingably mounted to inner housing 24. The door 86 is connected to threaded drive screw 90 by arm 88 and guide nut 92. The drive screw 90 is rotable mounted in outer housing 16 at its axial ends by bearing 97 and is connected door drive motor 94 through coupler 96. Arm 88 is connected to door 86 by a pair flanges 98 having aligned openings 100. The end of arm 88 extends through opening 100. The door 86 is provided with an annular seal 102 which engages the outer end 22 of opening 25. As the guide 92 is caused to move toward the forward end of housing 16, as shown by arrow 103, the door goes to the open position as illustrated in FIG. 1. When the carrier assembly 30 is in the retracted position as shown in FIG. 2 the arm 88 moves toward the rearward end of housing 16 so as to close the door 86 as illustrated in FIG. 2.

Figure 8:
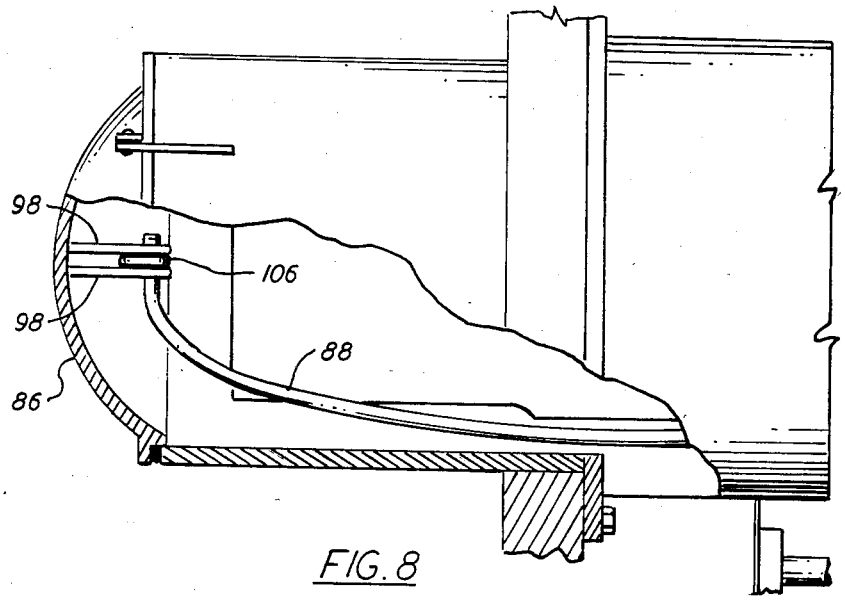
FIG. 8 is a an enlarged fragmentary view of the end of the apparatus of FIG. 2 illustrating the door closing mechanism.
Figure 9:
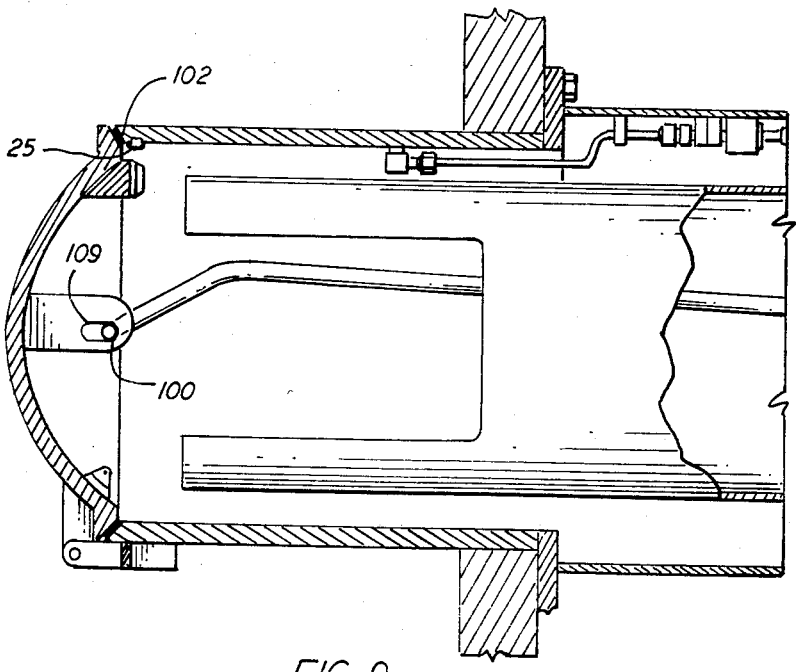
FIG. 9 is a top cross sectional view of FIG. 8.
Figure 10:
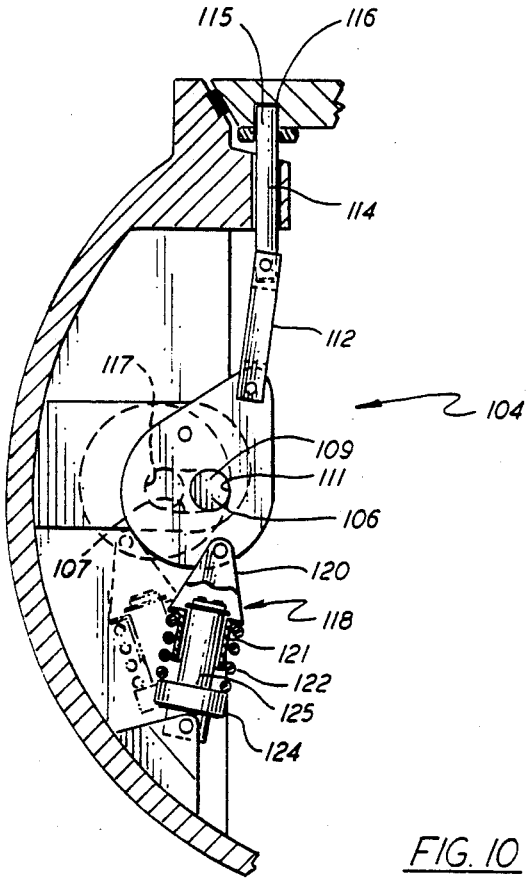
FIG. 10 is an enlarged fragmentary view illustrating the locking mechanism of the door locking assembly.

In order secure the door 86 in the closed position a locking mechanism 104 is provided. Locking mechanism 104 comprises a locking cam 106 pivotably mounted to flanges 98 by pin 109 and has an opening 107 through which the end of arm 88 extends. The opening 107 in locking cam 106 and openings 100 in flanges are substantially longitudinal slots. FIGS. 8, 9 and 10 illustrates the arm 88 in the fully retracted position. In this position, the end of arm 88 firmly engages the inside end 111 of opening 106 in cam 106. Cam 106 is pivotably connected to a connecting arm 112 which is pivotably connected to locking pin 114. The outer end 115 of locking pin 114 engages a recess 116 formed in inner end 25 of inner housing 24. When the arm 88 is caused to move forward and engage the outside end 117 of opening 107 in cam 106, this causes the pin 114 to disengage from the recess 116. A spring bias means 118 (shown partially broken away in FIG. 10) biases the pin 114 into recess 116. Bias means 118 comprises an arm 120 having one end pivotably mounted to cam 106. The other end of arm 120 has an opening 121. A connecting arm 124 is pivotably mounted to door 86 and has a pin 125 which extends through opening 121. The pin 125 is kept from sliding out of opening 121 by clip 126. A spring 127 is between shoulders on arm 120, 124. The arm 120 is secured to cam 106 such that when arm is against the inside end 111 of opening 107, the pin 114 is biased into recess 116 and when arm is against outside end 117 of opening 107 (as shown in dash lines), the pin is biased out of engagement. A feature of the locking mechanism 104 is that it is automatically operated by the same drive used to open and close door 86. It can be clearly seen that when the pin 114 is in recess 116, the door 86 is locked in position so as to prevent accidental escape of vapor from the vessel 12 into the housing 16 which then could potentially escape to atmosphere.

An important advantage of the present invention is that the retraction mechanism and/or other internal parts can be repaired or removed without interferring with the contents of vessel 12 or allowing undesirable vapors to escape. For example, repair can be made throught removable access panel 69, or any other access panel provided as desired, without interferring with the contents of the vessel 12. Since outer housing 16 is removably secured to flange 15, it can be removed relative simply from the vessel 12 and inner housing 24. Therefore, if door assembly 27 is in the closed position removal of retraction assembly can be easily accomplished with relatively few disconnections. Locking mechanism 104 will maintain the door in a sealed position when outer housing 16 is removed. Therefore, if the owner of apparatus 10 has several vessels that require infrequent cleaning, the majority of apparatus 10 can be used to clean several vessels, needing only to duplicate the mounting flanges, door assembly and inner housing at each location. This allows more efficient use of devices and ultimately lesser cost.

As shown in FIG. 1 a control unit 130, capable of being programmed by the operator as desired, is provided at the back end of outer housing 16. However, the control unit 130 may be placed at any location along the housing 16 or even at a remote location from the apparatus 10 as desired. This may be particularly important if space is of concern. The control unit 130 is used to control the operation of the apparatus 10, for example, the amount of time the vessel 12 will be subjected to a cleaning cycle. Additionally, the control unit 130 can be connected to an appropriate sensor to monitor various operations of the cleaning apparatus 10 and the vessel 12. In the particular embodiment illustrated, a sensor 132 is provided at spray means 57 for monitoring the operation thereof. Additional sensors may also be provided to monitor the status of other elements of the apparatus 10, for example, the status of the door means, the rate at which the carrier assembly 30 is being moved or whether it is moving at all, the position of the carrier assembly 30 and spray support assembly 31 within the housing 16 or vessel 12. The control unit 130 may be also programmed to prevent or stop operation of the apparatus 10 if a given condition is not correct, for example, the carrier assembly 30 will not be permitted to extend until the door is sensed as being open. The control unit 130 can, of course, be programmed to perform other functions as desired.

In order to more completely understand the present invention, the operation of the apparatus will now be described in detail. Referring to FIG. 2, the apparatus is shown in the fully retracted position. When the control unit 130 determines that the appropriate conditions exists for cleaning the interior of the vessel 12, the motor 94 is activated thereby causing locking mechanism 104 to disengage and door 86 to open as shown in FIG. 1. Once the door 86 has been completely opened, motor 94 is deactivated. Thereafter, motor 42 is activated so as to cause guide 48 to move forward which will cause carrier assembly 30 to extend out past door 86. The movement of carrier assembly 30 will cause spray support assembly 31 to also move forward out past the end of tube 36 by the pulley system 76 as illustrated in FIG. 1. The pulley system 76 causes rear collar assembly 54 to slide in slots 66. Front collar assembly slides in slots 60 initially by the friction of the pipe 55 and pipe 55 slides in front collar assembly 52. However, once projection 59, on pipe 55 engages front collar assembly 52, collar assembly 52 will positively be moved forward in slots 60. The motor 42 is operated until the spray means 57 is extended into the vessel 12 to the preprogrammed distance. After the spray means 57 has been extended the predetermined distance, a fluid delivery system is activated thereby causing a fluid under pressure to be delivered to hose 74. This fluid, which is generally a cleaning fluid, travels to spray means 57 and is thereby forced out by the pressure causing the fluid to spray against the interior of the vessel 12. Once the cleaning cycle is complete, the fluid is ceased to be delivered to the apparatus 10. The motor is caused to rotate in the opposite direction, thereby causing the carrier assembly 30 and spray support assembly to go back into the housing 16. The motor 94 is reversed, thereby causing the door to close and lock mechanism to engage.

It is to be understood that various changes and modifications may be made without departing from the scope of the present invention. The scope of the present invention being limited by the following claims.

What is claimed is:

1. An apparatus for directing a liquid spray against the interior walls of a vessel from a nozzle spray means comprising:

(a) a housing mounted externally on said vessel:
(b) a carrier assembly slidably mounted within said housing;
(c) a nozzle support assembly slidably mounted to said carrier assembly;
(d) door means on said housing for sealing said housing from the interior of said vessel and allowing entry of said carrier assembly into said vessel;
(e) nozzle spray means mounted on the end of said nozzle support assembly;
(f) a fluid delivery system passing within said housing terminated at said nozzle;
(g) means for extending said carrier assembly and said nozzle support assembly with said vessel at different rates using a single power drive means.

2. An apparatus for directing a liquid spray against the interior walls of a vessel from a nozzle spray means comprising:

(a) a housing mounted externally on said vessel;
(b) a carrier assembly slidably mounted within said housing;
(c) a pipe support assembly slidably mounted within said carrier assembly;
(d) door means on said housing for sealing seal said housing from the interior of said vessel and allowing entry of said carrier into said vessel;
(e) nozzle means mounted on the ned of said pipe support assembly;
(f) a fluid delivery system passing within said housing terminating at said nozzle means;
(g) mechanical means for extending said carrier assembly out past said door means into said vessel, said mechanical means comprising a threaded drive screw connected to a first drive means for turning said drive screw about its axis, a guide traveler mounted to said carrier assembly and threadably engaged to said screw drive so as to be moved along said screw drive in response to said first drive motor, drive means connecting said carrier assembly and said pipe support assembly so as to cause said pipe support assembly to be slidably moved within said carrier assembly out past the end thereof.

3. An apparatus according to claim 2 wherein said carrier assembly comprises a cylindrical tube, having a first and second slot, said pipe support assembly having a first collar assembly and a second collar assembly, said first and second collar assemblies being slidably mounted within said first and second slots of said cylindrical tube respectively.

4. An apparatus according to claim 2 wherein said door means includes a second threaded drive screw connected to a second drive means, said second threaded drove screw having a threaded follower mounted thereon capable of moving in the axial direction in response to said second drive means, said follower being connected to an arm which is secured to said door to either open or close said door in response to movement of said follower along said threaded drive screw.

5. An apparatus according to claim 2 further comprising a locking mechanism for positively locking and unlocking said door.

6. An apparatus according to claim 5 wherein said door means further comprises an arm secured to the door, drive motor means for moving said arm so as to open and close said door and wherein said locking mechanism for positively locking said door in the closed position comprised a locking cam rotatably mounted between a pair of flanges secured to said door and connected to said arm, said cam being connected to a locking pin which engages a recess in said housing.

7. An apparatus according to claim 6 wherein said cam is provided with an over the center biasing means to positively position the locking mechanism in either the open or closed position.

8. An apparatus according to claim 2 wherein said housing comprises a mounted flange secured to said vessel, an inner housing secured to said mounting flange and an outer housing removably mounted to said mounting flange.

* * * * *